US008123112B2

(12) United States Patent
Nikon

(10) Patent No.: US 8,123,112 B2
(45) Date of Patent: Feb. 28, 2012

(54) SELF-LOCKING SECURITY MECHANISM WITH UNIVERSAL MOUNTING FUNNEL FOR COIN OPERATED MACHINE

(76) Inventor: Alexander Nikon, Wheeling, IL (US)

( * ) Notice: Subject to any disclaimer, the term of this patent is extended or adjusted under 35 U.S.C. 154(b) by 148 days.

(21) Appl. No.: 12/700,498

(22) Filed: Feb. 4, 2010

(65) Prior Publication Data

US 2011/0186622 A1 Aug. 4, 2011

(51) Int. Cl.
*G07B 15/00* (2006.01)

(52) U.S. Cl. ..... 232/15; 232/16; 232/44; 194/351; 206/0.8; 109/66

(58) Field of Classification Search ..... 232/15, 232/16, 1 D, 43.2, 44, 55, 57, 58; 194/344, 194/350–351, 202; 206/807, 0.8, 0.815; 109/64, 66
See application file for complete search history.

(56) References Cited

U.S. PATENT DOCUMENTS 3,797,735 A 3/1974 Sciortino
3,807,627 A 4/1974 Nitschneider
4,177,920 A 12/1979 Sciortino
4,267,962 A 5/1981 Domkowski
4,289,269 A 9/1981 Sciortino
4,291,831 A 9/1981 Domkowski
4,359,184 A 11/1982 Sciortino
4,372,479 A 2/1983 Sciortino
4,456,165 A 6/1984 Sciortino
5,458,285 A * 10/1995 Remien ..... 232/15
5,611,483 A 3/1997 Sciortino
6,598,787 B1 7/2003 Grinsteiner

* cited by examiner

*Primary Examiner* — William L. Miller
(74) *Attorney, Agent, or Firm* — Meroni & Meroni, P.C.; Charles F. Meroni, Jr.; Christopher J. Scott

(57) ABSTRACT

A self-locking security mechanism for coin-operated machines. This mechanism consists of two units. The first unit mounts inside a coin-operated machine in alignment with the coin chute for receiving coins passing through the first unit. A second unit has a flexible bag secured thereon into which the coins are stored after passing through the second unit. This second unit also includes a door, which slides to an open condition by two teeth from the first unit when the second unit is connected by sliding into the first unit. The door is pushing the pivoting arm, which passes the snap stops and stays in preset condition. A pivoting arm is attached to the pivoting stopper with a spring between them. When the second unit is removed from the first unit, the door slides to a closed condition and releases the stopper. The spring lifts the stopper and blocks the door from sliding to an open condition. Only an authorized person can unlock the locked coin receptacle.

17 Claims, 18 Drawing Sheets

SELF-LOCKING SECURITY MECHANISM WITH UNIVERSAL MOUNTING FUNNEL FOR COIN OPERATED MACHINE

CROSS-REFERENCE TO RELATED APPLICATIONS

| | | | |
|---|---|---|---|
| 3,797,735 | Mar. 19, 1974 | August M. Sciortino | 232/16 |
| 3,807,627 | Apr. 30, 1974 | Robert M. Nitschneider | 232/15 |
| 4,177,920 | Dec. 11, 1979 | August M. Sciortino | 232/16 |
| 4,267,962 | May. 19, 1981 | Ronald A. Domkowski | 232/15 |
| 4,289,269 | Sep. 15, 1981 | August M. Sciortino | 232/16 |
| 4,291,831 | Sep. 29, 1981 | Ronald A. Domkowski | 232/15 |
| 4,359,184 | Nov. 16, 1982 | August M. Sciortino | 232/16 |
| 4,372,479 | Feb. 8, 1983 | August M. Sciortino | 232/15 |
| 4,456,165 | Jun. 26, 1984 | August M. Sciortino | 232/15 |
| 5,611,483 | Mar. 18, 1997 | Michael J. Sciortino | 232/15 |
| 6,598,787 B1 | Jul. 29, 2003 | James J. Grinsteiner | 232/15 |

FEDERALLY SPONSORED RESEARCH

Not Applicable

SEQUENCE LISTING OR PROGRAM

Not Applicable

BACKGROUND

1. Field of Invention

This invention relates to coin-operated vending machines, specifically to an improved coin security mechanism for collecting and storing money.

2. Prior Art

Coin operated machines, such as machines for vending products, commonly include a coin receptacle installed in the interior thereof in position to receive and collect coins which have been inserted to activate the machine. Typically, vending machines are serviced by one or more route men and technician who periodically visit the machine and replenish the supply of merchandise and collect the money which has been accepted and stored by the machine. In some installations different individuals may collect the coin receptacles and replenish the supply of merchandise.

A serious problem has developed in the industry concerning the pilferage of coins by persons collecting money from the machines. Dishonest individuals have removed portions of the money collected before turning the money in to the home office. Moreover, this is accomplished without damage to any parts of the machine by persons who have access to the interior of the cabinet. It is not an easy matter to pinpoint the source of such losses.

Various systems have been proposed in the prior art for overcoming the problem outline above. For example, it has been suggested that an assembly be provided that includes a normally closed opening on the mouth of the coin receptacle, in which the opening is unblocked as the coin receptacle is assembled on the coin mechanism. The opening is blocked when the coin receptacle is removed from the coin mechanism, so that the route man is always carrying a closed coin receptacle, whether it is full or empty. Stated otherwise, the person servicing the machine is provided with a normally locked empty coin receptacle. In order to collect the money from a particular machine, the route man must remove the full receptacle, which automatically closes the receptacle's mouth as it is removed. The person then assembles the empty receptacle into the coin mechanism and in so doing, opens the mouth of the replacement receptacle. Servicemen return the locked receptacle to the main office whereat a receptacle is opened by use of a key. This key is not accessible to the servicemen. In this way, a person collecting coin receptacles cannot gain access to coins therein without damaging the receptacle in some way, which would make his guilt apparent.

While systems of the prior art for achieving the result outlined above have been more or less partially solved. In U.S. Pat. Nos. 3,807,627 and 4,267,962 and 4,291,831 a security mechanism has two locks. One lock controls the door in open condition when the coin receptacle is installed into the security mechanism and in locked condition when it is removed for delivery to the home office. The second lock prevents the coin receptacle from turning after it is secured in the security mechanism. This second lock increases the overall security mechanism cost.

The person servicing the machine removes the receptacle from the security mechanism to install an empty one. During this replacement, nothing covers the exposed key that controls the door lock. A serviceman can make an impression of the key and create a duplicate key. Next time dishonest individuals will be able to open the coin receptacle and remove a portion of the money collected before returning the coin receptacle to the home office.

Using the same key for the door lock reduces the protection for all coin receptacles. If each machine has a personal key, it creates a disadvantage as each vending machine must have two personal bags and a key. The home office would need to manage a large quantity of keys. In this situation, if something broke it would be necessary to replace the entire security mechanism in that vending machine as the key and the corresponding receptacles are not universal.

The security mechanism mounted inside the vending machine is under a coin chute that allows individual coins to fall into the coin bag without jamming. This coin bag is delivered to the home office, in which only authorized people can remove the money with a key that opens the receptacle mouth. The authorized key holder then flips the bag so that the coin mouth faces downward. All coins in the bag are jammed at the mouth because the mouth is too small for more than one coin to pass through.

Coin operated machines originate from different manufacturers for many purposes, and each model has a specific configuration of its internal structure. This requires a custom adaptor between the coin chute and the security mechanism to guide the coins into the coin receptacle.

Other types of security mechanisms referred in U.S. Pat. Nos. 4,359,184 and 4,456,165 are not fully secured. Any person who has access to coin receptacles can open it, make a pilferage, reset the mechanism and close it if there are no additional locks or seals.

Using a spring stopper in the coin receptacle is a huge disadvantage. The spring stopper is flexible and bends during use. The stopper part must be durable and should not bend to allow parts to pass over the spring stopper when the receptacle is removed from the vending machine. This problem was described in U.S. Pat. No. 4,456,165. This security mechanism that has a spring stopper cannot stop pilferage.

A modified security mechanism design introduced a rib strengthened spring with a groove. The groove formed directly across the width of the spring stopper. If someone reinstalls the receptacle, the spring stopper will shear at the grooved location and destroy the receptacle, which cannot be repaired. This modified design of the spring stopper with the rib strengthened spring and groove is not reliable. In normal operation the biggest stress is concentrated at the grooved area, which mechanically weakens and breaks after repeated use.

U.S. Pat. No. 4,289,269 represents a funnel with mounting brackets. The mounting brackets inside the funnel mount only to a horizontal flat surface. In the past, all coin operated machines are different and some have a large opening for the coins. In this case, the mounting brackets are in the way of the coins and the funnel needs an additional custom plate for mounting the security mechanism.

In U.S. Pat. Nos. 5,611,483 and 6,598,787 B1 different types of security mechanisms are shown with a coin bag. This bag has a zipper for removing coins and allows access for resetting the receptacle mechanism. The zipper of a bag must be secured by an additional lock or a temporary seal. This design of the receptacle mechanism has a problem. The person who has knowledge about that mechanism can easily open the receptacle door with a wire hook. The wire hook can be inserted through the coin bag and catches the lock arm that releases the receptacle door when the arm pulled down.

Accordingly, the present inventions provide a security system, which is adaptable for use in coin operated vending machines and has the above-noted problems in the coin security mechanism. The security system, in accordance with the proposed invention, has improved versatility and is readily adapted to fit a variety of vending machines without additional brackets and modifications to the vending machine.

SUMMARY OF THE INVENTION

The object of my invention is to provide an improved self-locking mechanism with an attached coin bag that is used in vending machines to prevent a serviceman from gaining access to the interior of the coin receptacle.

Moreover, the device in accordance with this invention has an improved versatility and is readily adapted to fit a variety of vending machines without substantial modification to the vending machine.

The self-locking mechanism is comprised of a pair of plastic molded units that can be assembled in any vending machines. The first unit has a funnel with flexible legs for installation in a specified location in the vending machine. A second unit is constructed to be removable assembled to the first unit for receiving the coins that flow through the first unit. The second unit has a flexible bag secured thereon into which the coins are stored in after passing through the second unit.

The two units have cooperating teeth which belong to the first unit. A second unit has a door which engages with the teeth of the first unit when the two units are assembled together by sliding the second unit into the first unit. The door is pushing a locking member. The locking member consists of: pivoting arm, stopper, and torsion spring assembled together by a pin. The torsion spring pushes the pivoting arm and the rocking stopper in opposite directions. When the second unit is fully installed, the door slides in an open condition and the pivoting arm slides over the stops in a preset condition.

When the second unit is removed from the first unit, the door slides in a closed condition and releases the locking member. The torsion string lifts the stopper that blocks the door from sliding back in an open condition. This stopper keeps the door from opening during closed condition, until an authorized person resets the second unit.

BRIEF DESCRIPTION OF THE DRAWINGS

Further objects and features of the present invention will become more apparent from the following description of a preferred embodiment thereof, as shown in the accompanying drawings, in which.

DETAILED DESCRIPTION OF THE INVENTION

Figure 1:
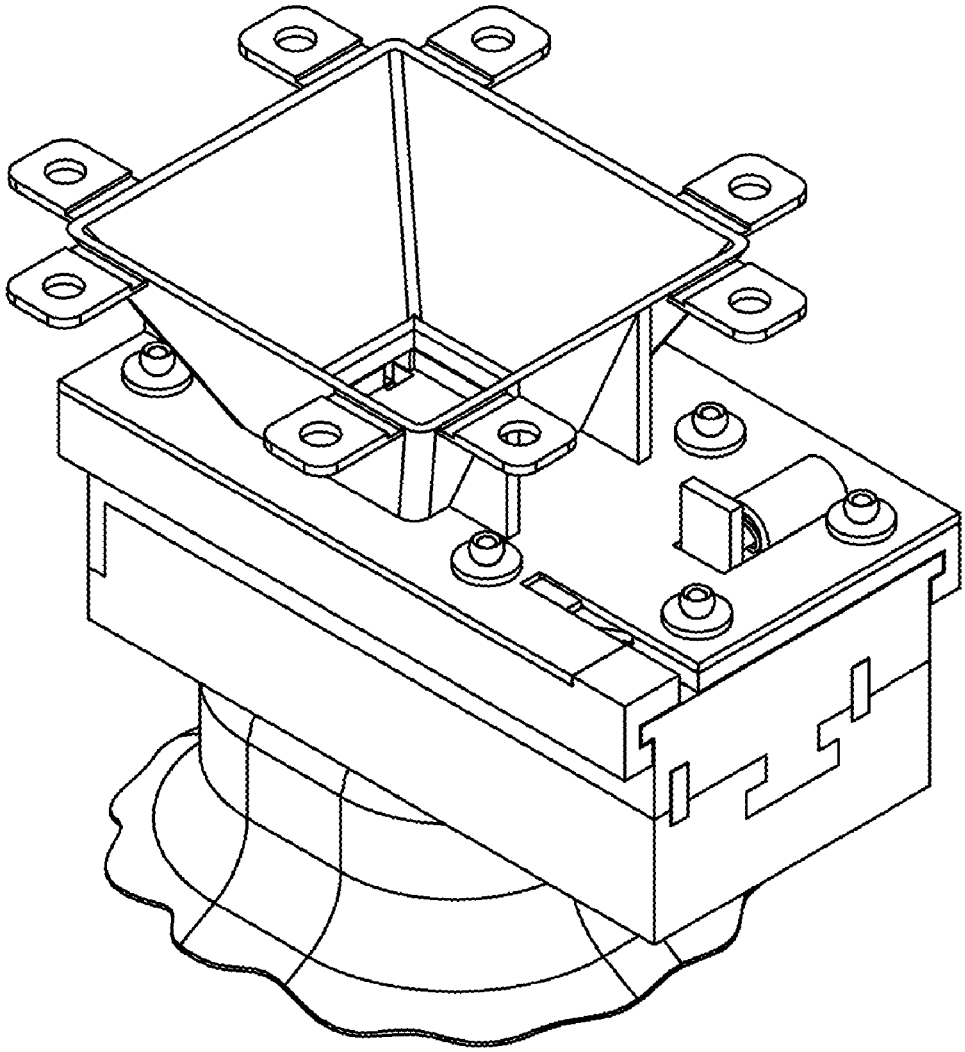
FIG. 1 is a perspective view looking downward on the present invention of the self-locking security mechanism.
Figure 2:
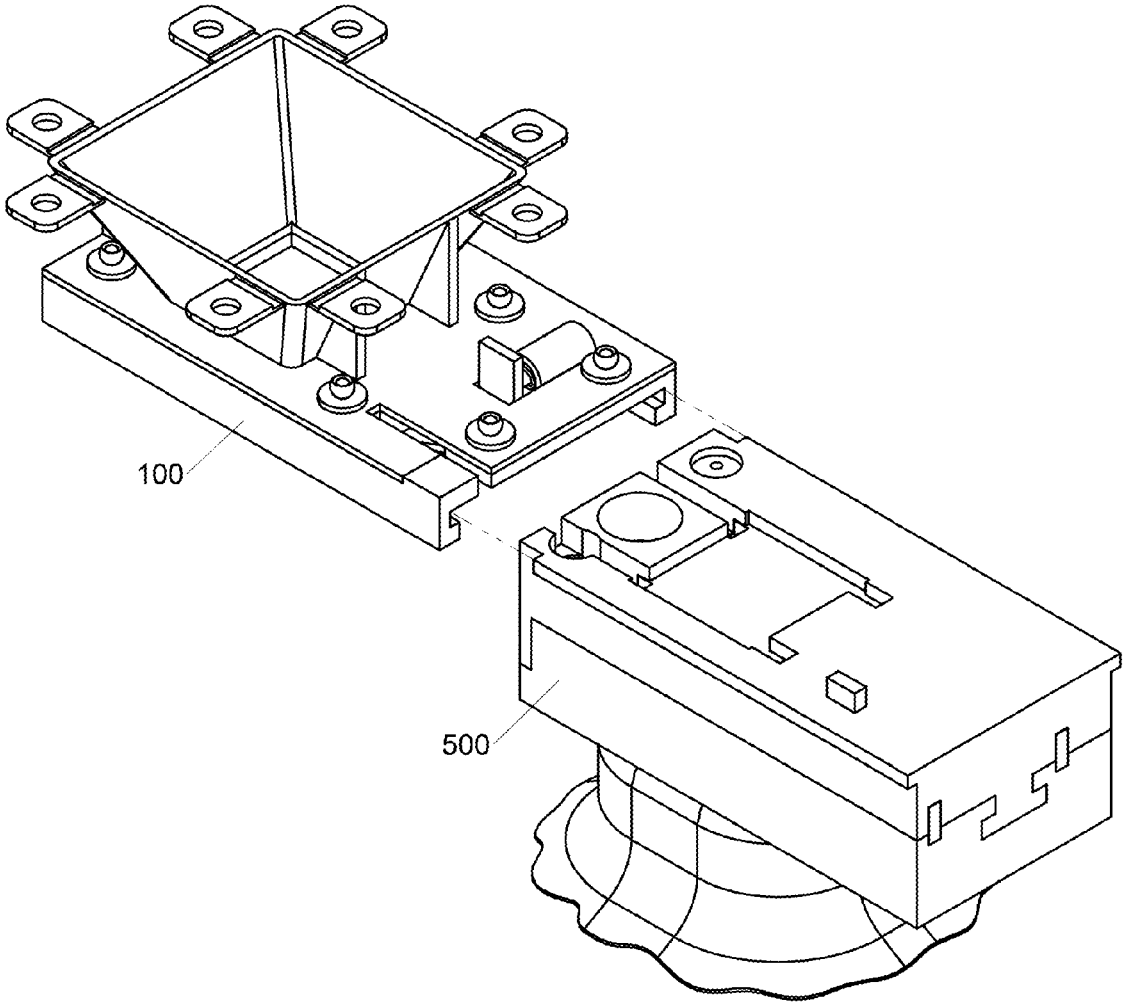
FIG. 2 is an exploded perspective view of the self-locking security mechanism, showing the interrelationship between the first and second unit.

As seen in the drawings, the self-locking security mechanism, in accordance with this invention, includes two units. The first unit is assembly 100 and second unit is assembly 500 as shown in FIG. 2. Unit 100 is adapted to be secured inside a vending machine by rivets (not shown) and designed to receive the various coins which are inserted into the machine during the vending operation.

Figure 3:
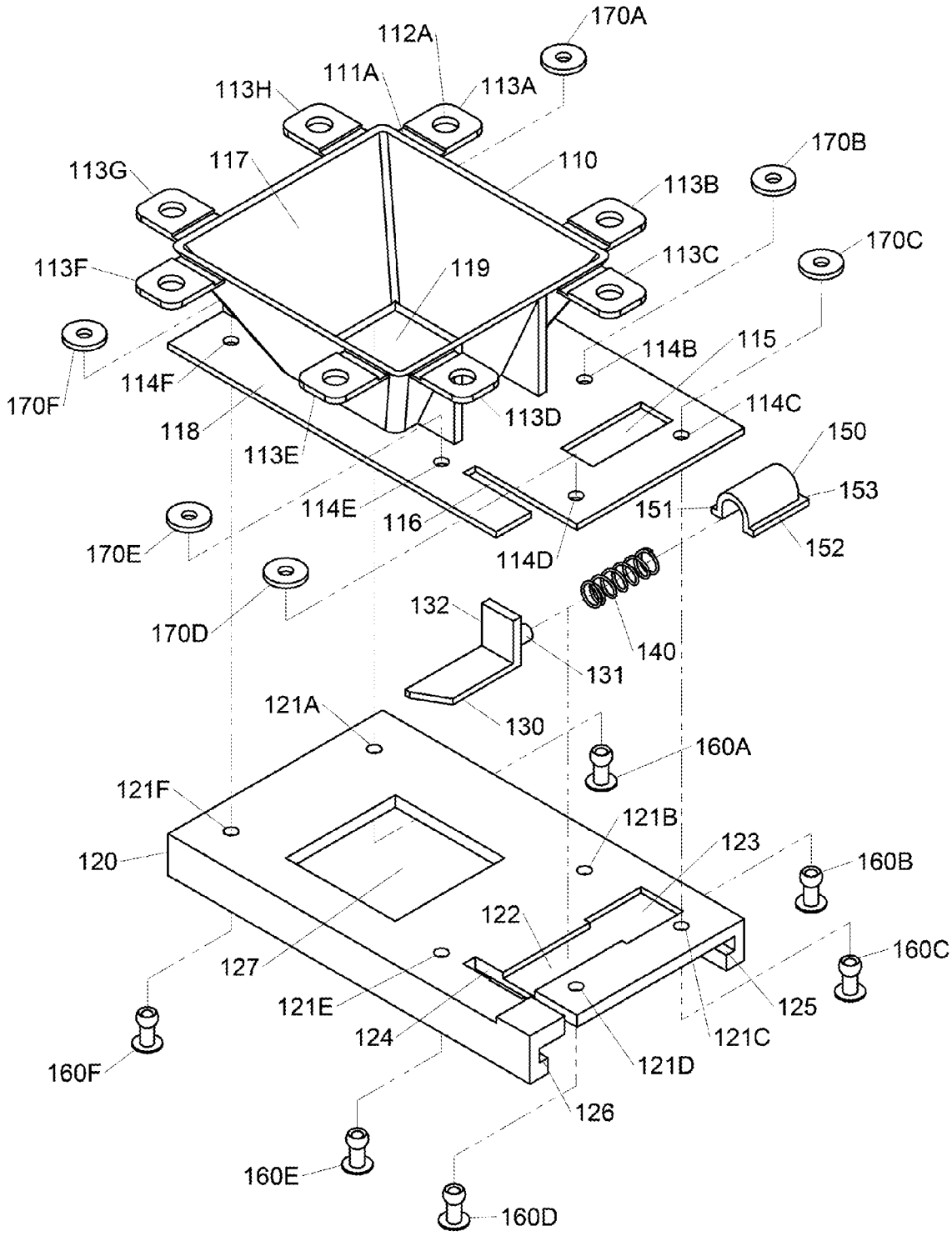
FIG. 3 is an exploded perspective view of the first unit of the security mechanism in accordance with this invention.
Figure 4:
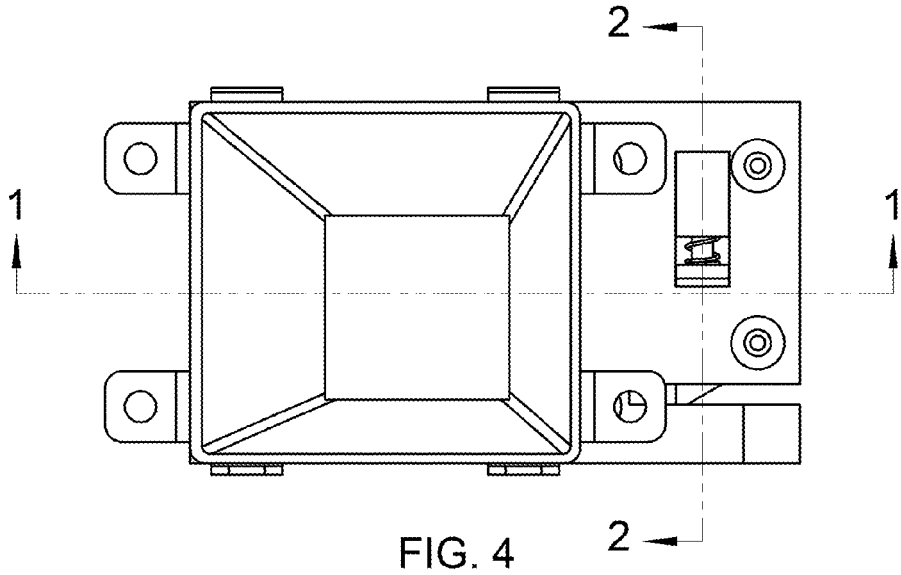
FIG. 4 is a top view of the first unit shown with sectional lines 1 and 2.

More specifically, unit 100 is illustrated in FIG. 3. Referring to those figures unit 100 consists of: mounting connector 110, receiver 120, lock 130, spring 140, and cover 150. All these parts, except spring 140, are made from a lightweight cast plastic material to minimize weight and expense.

Figure 5:
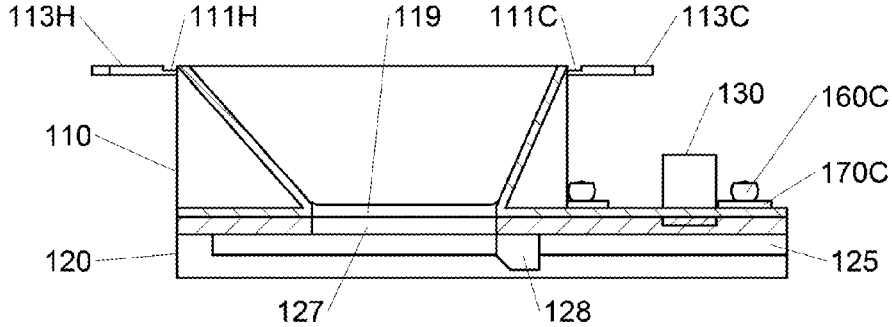
FIG. 5 is a sectional view taken along line 1-1 of the FIG. 4.

Connector 110 and receiver 120 are assembled together by rivets 160 and washers 170. Rivets 160 go through holes 121 and 114 of connector 110 and receiver 120 appropriately. Plate 118 of connector 110 has square hole 119 and notch 116 which are lined up with square hole 127 and notch 124 of receiver 120. FIG. 5 represents a section view of a square window which lets coins pass through unit 100.

The cover 150 is inserted into rectangular pocket 123 of receiver 120. The depth of this pocket matches with thickness of ribs 151, 152 and 153 of cover 150. That keeps ribs of cover 150 between receiver 120 and plate 118 of connector 110. The section view on FIG. 6 and exploded view on FIG. 3 shows receiver 120 has groove 122 which allows lock 130 to slide when covered by plate 118. Lock 130 has pin 131 which is inserted into spring 140 to keeps spring between cover 150 and pocket 123.

Figure 6:
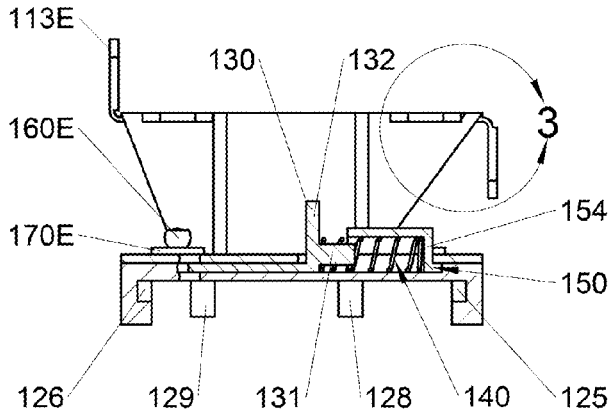
FIG. 6 is a sectional view taken along line 2-2 of FIG. 4, illustrating a different manner of adopting the first unit into a machine that has a different mounting position.
Figure 7:
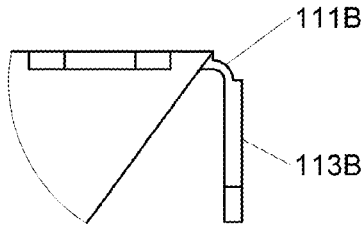
FIG. 7 is a detail view taken from FIG. 6 and illustrating a mounting leg.

Connector 110 has funnel 117 which lines up with the square hole 119. Funnel 117 has a shape of a truncated pyramid that allows unit 100 to reach the coin chute in the corner of a vending machine. The top of funnel 117 has legs 113 with mounting holes 112. Legs 113 have grooves 111. Grooves 111 increases flexibility which allows legs 113 to bend and attach to any surface under the coin chute in a vending machine. FIG. 6 and FIG. 7 show legs 113 in different manner.

The bottom part of receiver 120 has grooves 125 and 126 for ribs 227 and 228 to insert unit 500. Receiver 120 has two teeth, 128 and 129, which urging cooperates with door 250 of receptacle 200.

Figure 8:
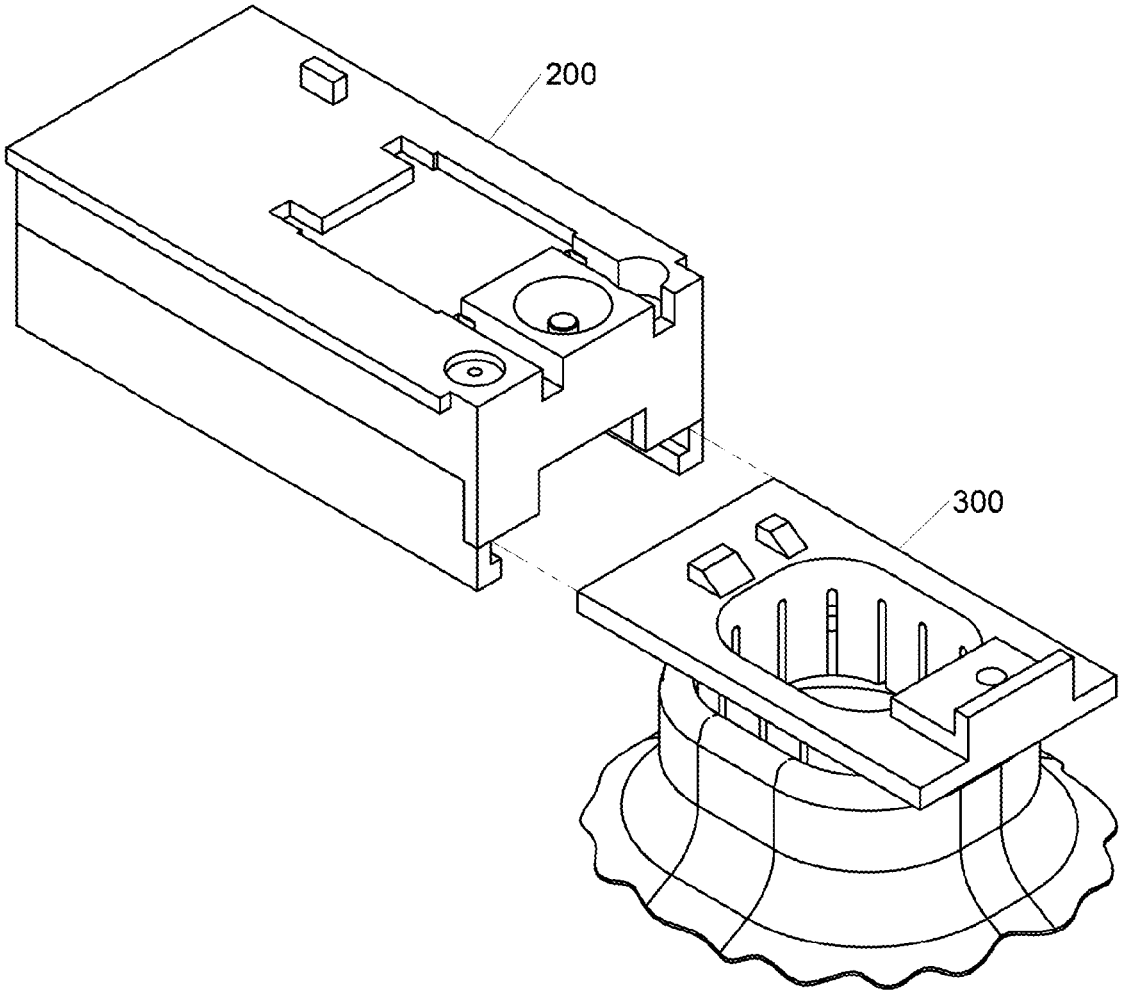
FIG. 8 is an exploded view of the second unit assembly, showing the interrelationship between the receptacle and a bag holder assembly.

The second unit assembly 500 is major component of the present security system and consists of: receptacle assembly 200 with coin bag assembly 300. Both receptacle 200 and coin bag 300 are illustrated in FIG. 8.

Figure 9:
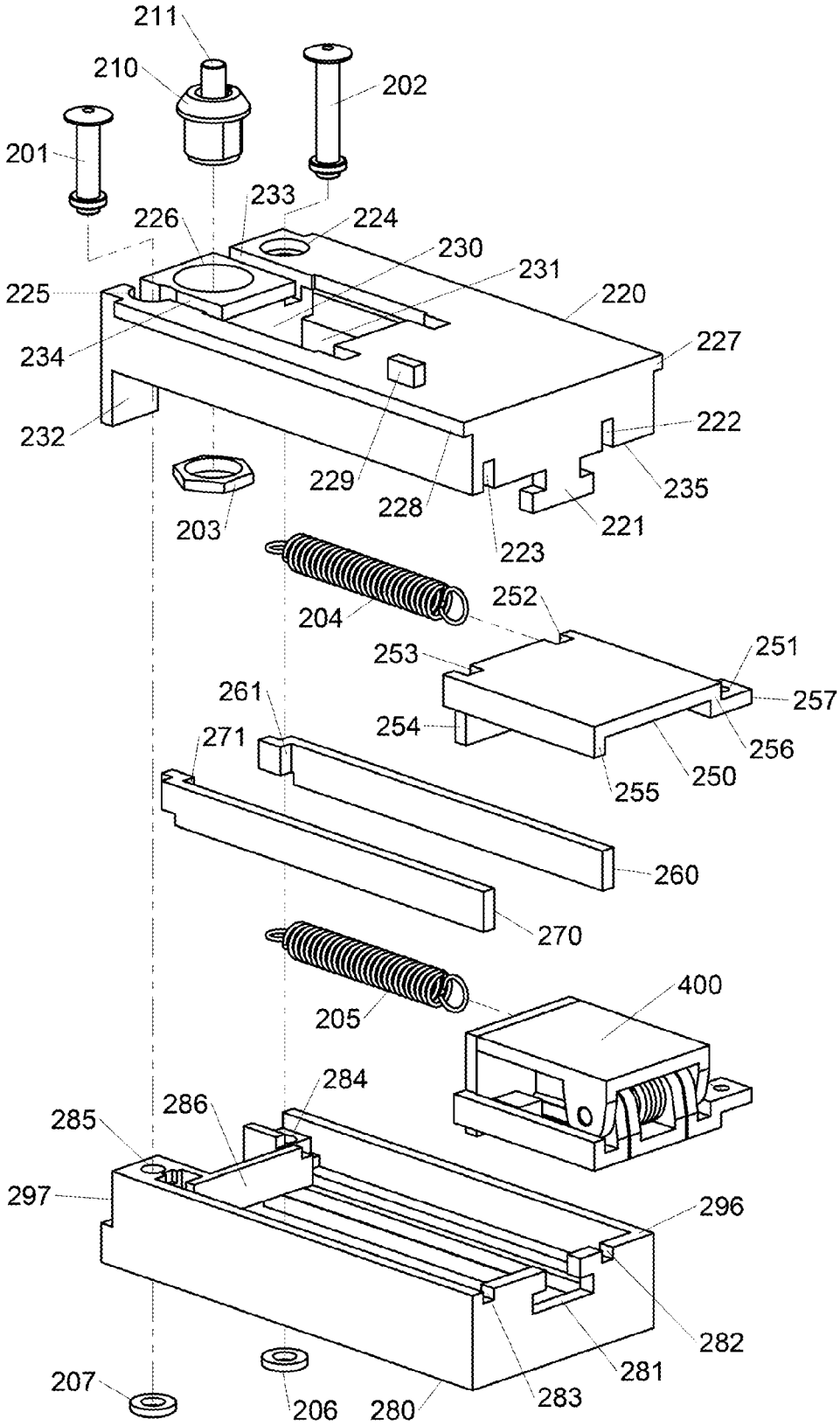
FIG. 9 is an exploded view of the receptacle assembly.
Figure 10:
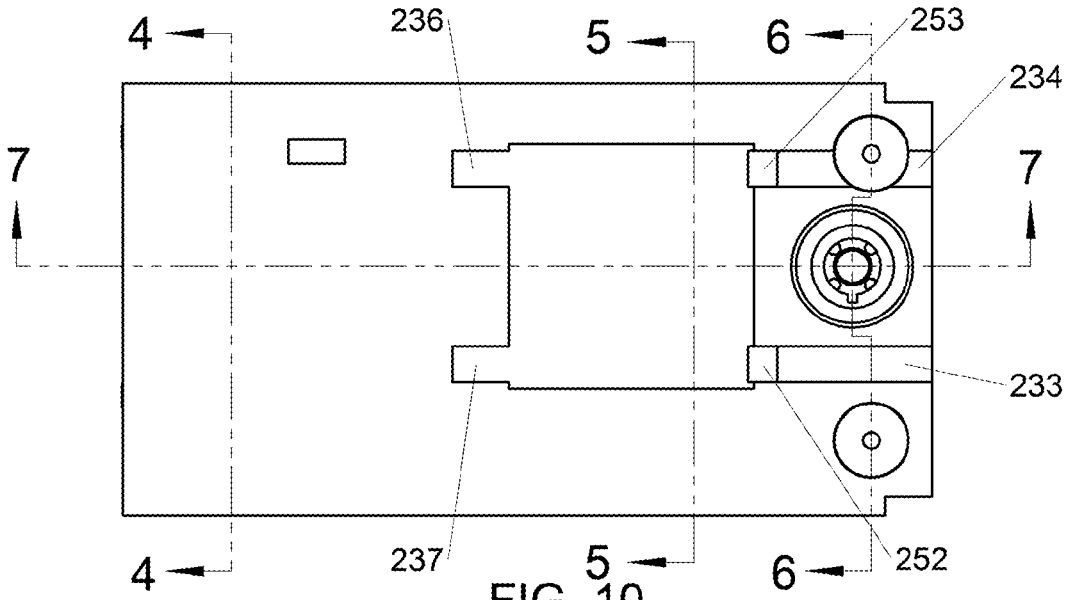
FIG. 10 is a top view looking downward of the receptacle assembly with section lines 4, 5, 6 and 7.

More specifically receptacle 200 is shown on FIG. 9. Receptacle mechanism 200 consists of upper case 220 and lower case 280. Both cases constrain the internal parts so that they move properly during operation.

Figure 11:
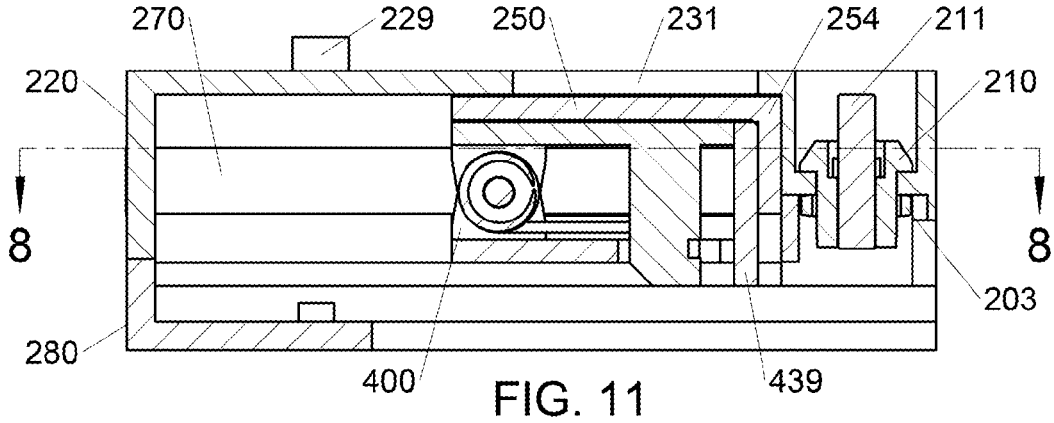
FIG. 11 is a sectional view taken along line 7-7 of FIG. 10 with section line 8.

Upper case 220 is assembled with lock 210. Lock 210 is inserted into counter-bore 226 and passes through upper case 220. Nut 203 tightens lock 210 from the other side. FIG. 11 shows the installed lock 210.

The next main part of receptacle 200 is door 250. Door 250 has the extension 257 with hole 251. Spring 204 is attached to that hole. Rivet 202 inserted into hole 224 of upper case 220 and passes through the other end of spring 204. Upper case 220 has rib 238. Rib 238 and walls 239 and 240 constrain door 250 from rotating and moving properly during operation.

Figure 12:
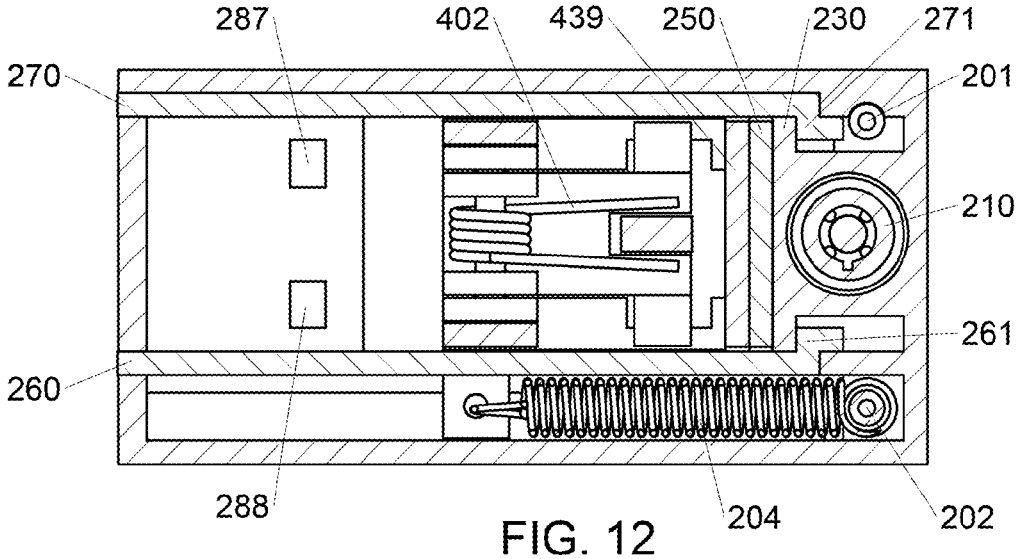
FIG. 12 is a sectional view taken along line 8-8 of FIG. 11.
Figure 13:
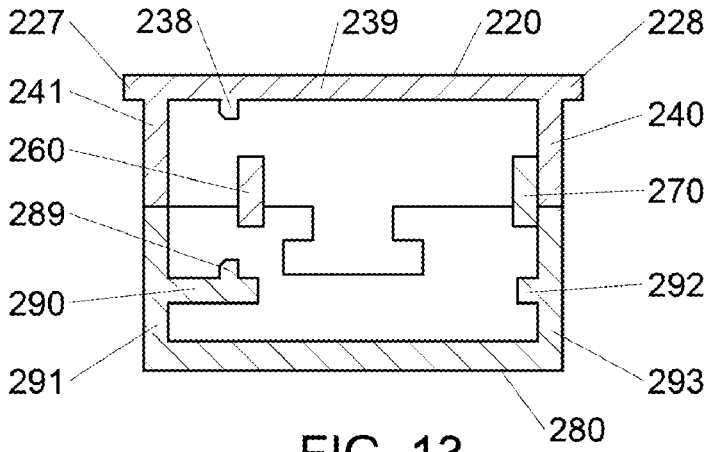
FIG. 13 is a sectional view taken along line 4-4 of FIG. 10.
Figure 14:
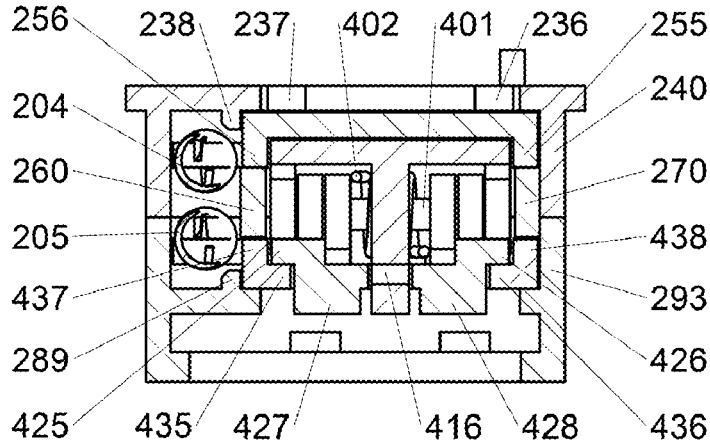
FIG. 14 is a sectional view taken along line 5-5 of FIG. 10.

Two other parts of receptacle 200 are spacers 260 and 270. They are assembled with upper case 220 to keep door 250 inside upper case 220. Door 250 is able to slide in an open or closed position because spacers 260 and 270 create enough clearances for walls 255 and 256. FIG. 14 shows door 250 installed between upper case 220 and spacers 260 and 270. Spacer 260 is inserted into notch 235 of upper case 220, and other end by step 261 catch wall 230 of upper case 220. Wall 230 prevents spacer 260 from sliding out of upper case 220. Spacer 270 is assembled the same way as spacer 260 because they are identical. FIG. 12 and FIG. 13 represent as stated above.

Figure 16:
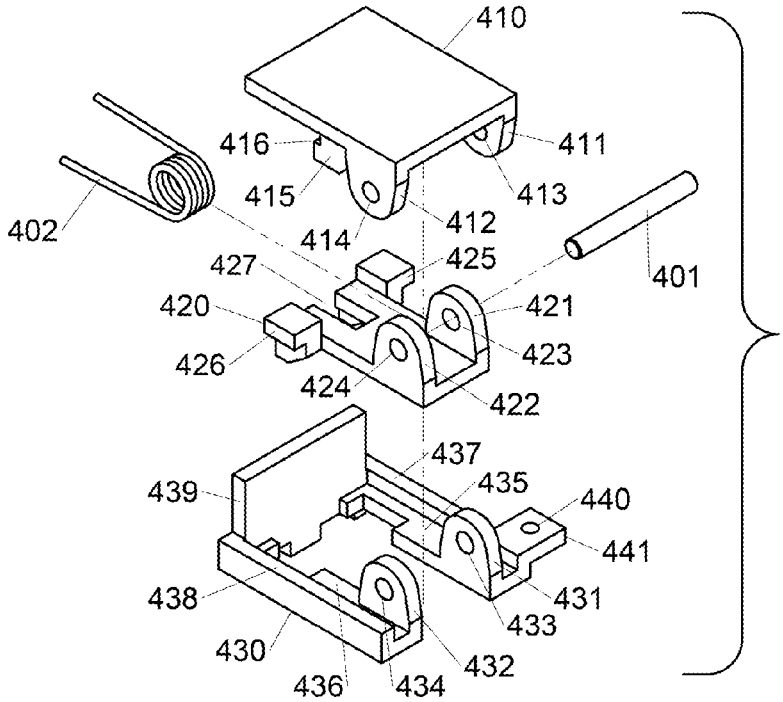
FIG. 16 is an exploded view of the locking member.
Figure 17:
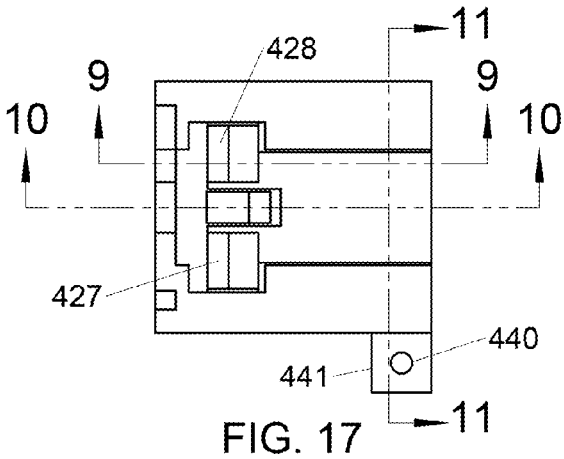
FIG. 17 is a bottom view of the locking member with section lines 9, 10 and 11.
Figure 18:
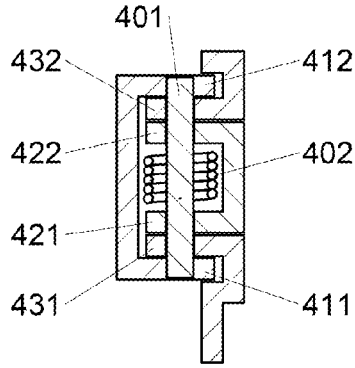
FIG. 18 is a sectional view taken along line 11-11 of the FIG. 17.
Figure 19:
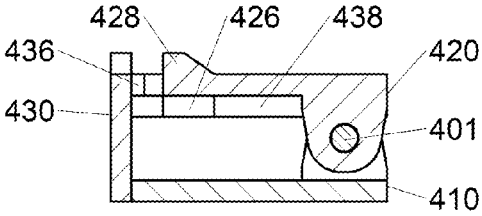
FIG. 19 is a sectional view taken along line 9-9 of the FIG. 17.
Figure 20:
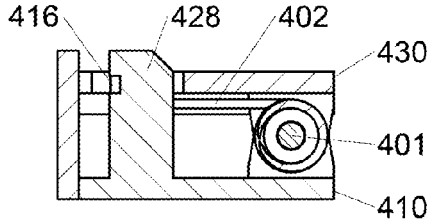
FIG. 20 is a sectional view taken along line 10-10 of the FIG. 17.

FIG. 16 shows an exploded view of locking member 400. Locking member 400 consists of five main parts: stopper 410, pivoting arm 420, torsion spring 402, slider 430, and pin 401. Slider 430 has two vertical walls 432 and 431 with holes 434 and 433 appropriately. The arm 420 has walls 422 and 421 which are inserted between walls 432 and 431 of slider 430. Holes 434 and 433 of the slider are lined up with holes 424 and 423 of arm 420. Arm 420 has extensions 426 and 425 which lay on horizontal walls 436 and 435 of slider 430. The coil of spring 402 is inserted between the arm's walls 422 and 421, and lines up with holes 424 and 423. Holes 414, 413 of the stopper 410 line up with the slider's holes 434 and 433. Handle 415 of stopper 410 passes through notch 427 of arm 420. Pin 401 passes through the aligned holes 433, 423, coil of spring 402, holes 424 and 434 and completes the assembly of locking member 400. FIG. 17, FIG. 18, FIG. 19 and FIG. 20 represent this locking member 400.

Slider 430 has extension 441 with hole 440. Spring 205 is assembled with hole 440. Rivet 202 passes through the other end of spring 205. Locking member 400 with spring 205 inserted into upper case 200 between spacers 260 and 270 until walls 438 and 437 of the slider lay on spacers 270 and 260. Spring 205 keeps locking member 400 engaged with door 250. FIG. 11 and FIG. 12 depict the steps described above.

Walls 293 and 291 of the lower case line up with walls 240 and 241 of the upper case thereafter. Surface 296 of the lower case 280 lay on surface 235 of the upper case 220. T-lock 221 is inserted inside lower case 280. Lower case 280 slides until wall 232 of upper case 220 engages with surface 297 of lower case 280, hereby T-lock 221 slides into notch 281. Notches 283 and 282 of lower case 280 cover spacers 270 and 260 when lower case 280 is engaged with upper case 220. The holes 224, 225 from upper case 220 line up with holes 284 and 285 from lower case 280. Rivets 201 and 202 can pass through lower case 280 and washers 207, 206. Rivets 201, 202 caught washers 207, 206 thereafter upper case 220 and lower case 280 cannot disengage.

Figure 15:
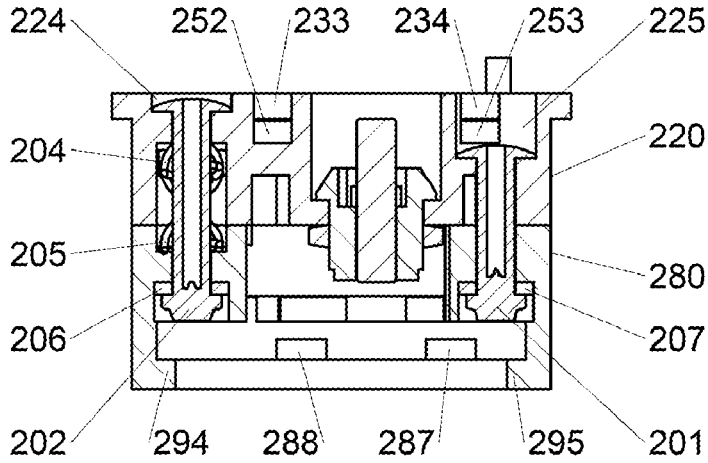
FIG. 15 is a sectional view taken along line 6-6 of FIG. 10.

Spacers 260 and 270 with ribs 289, 290 and 292 of the lower case keep slider 430 of locking member 400 aligned for sliding with door 250. FIG. 14 and FIG. 15 depict these steps.

Figure 21:
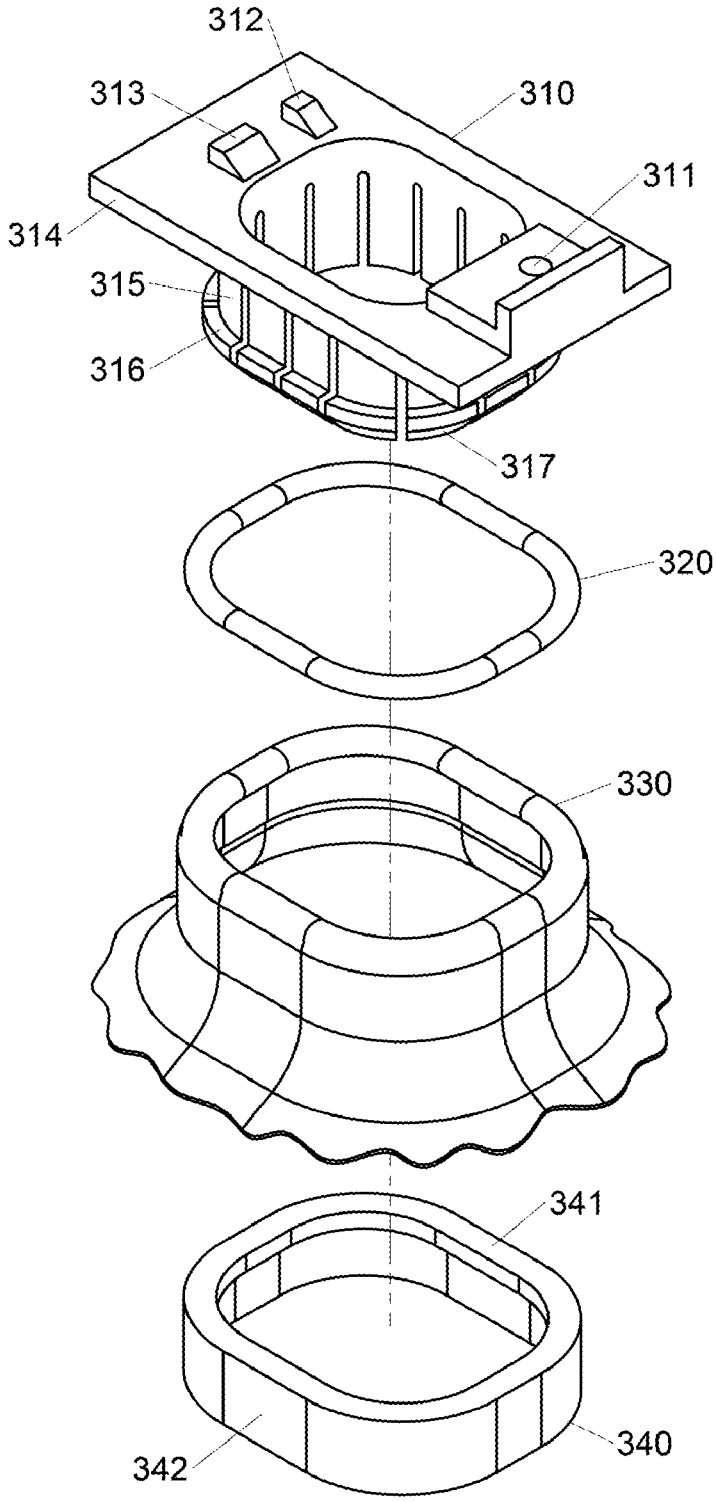
FIG. 21 is an exploded view of the bag holder assembly.
Figure 22:
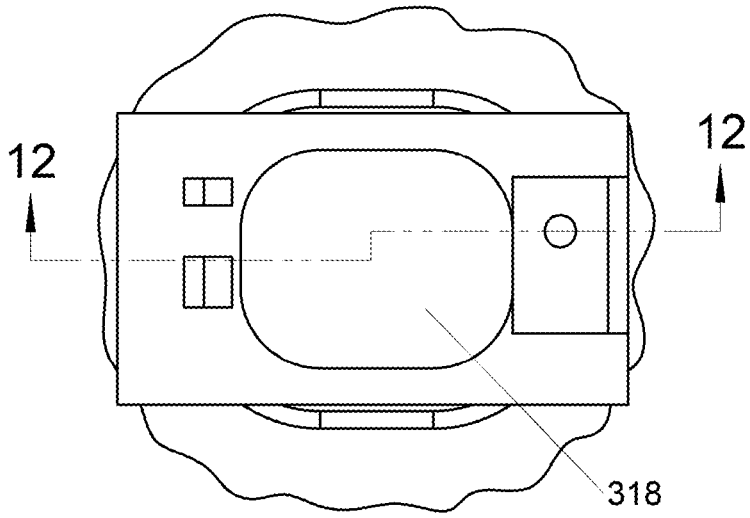
FIG. 22 is a top view of the bag holder assembly with section line 12-12.

FIG. 8 shows coin bag assembly 300 with receptacle 200. More specifically, the coin bag assembly is shown on FIG. 21. Coin bag assembly 300 consists of plate 310, ring 320, bag 330 and protector 340.

Coin bag assembly 300 can be of any shape and capacity. The top part of bag 330 contains ring 320 which is sewn to the bag's wall 311 and 332. Protector 340 is inside bag 330 and cannot be removed from bag 330 because protector 340 is bigger than ring 320.

Figure 23:
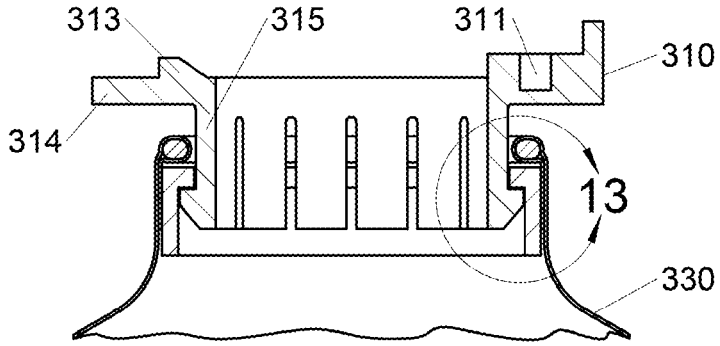
FIG. 23 is a sectional view taken along line 12-12 of the FIG. 22.
Figure 24:
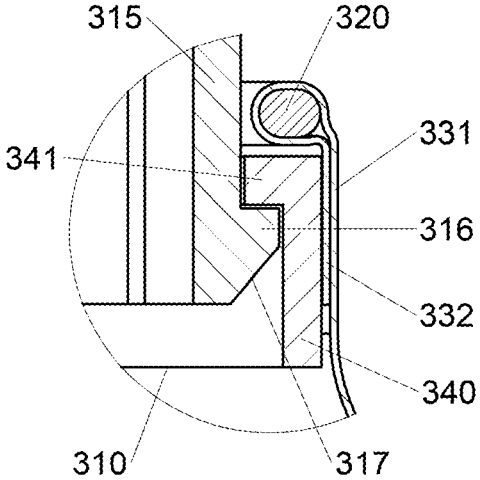
FIG. 24 is a detail view taken from FIG. 23 and illustrating attached flexible bag.
Figure 25:
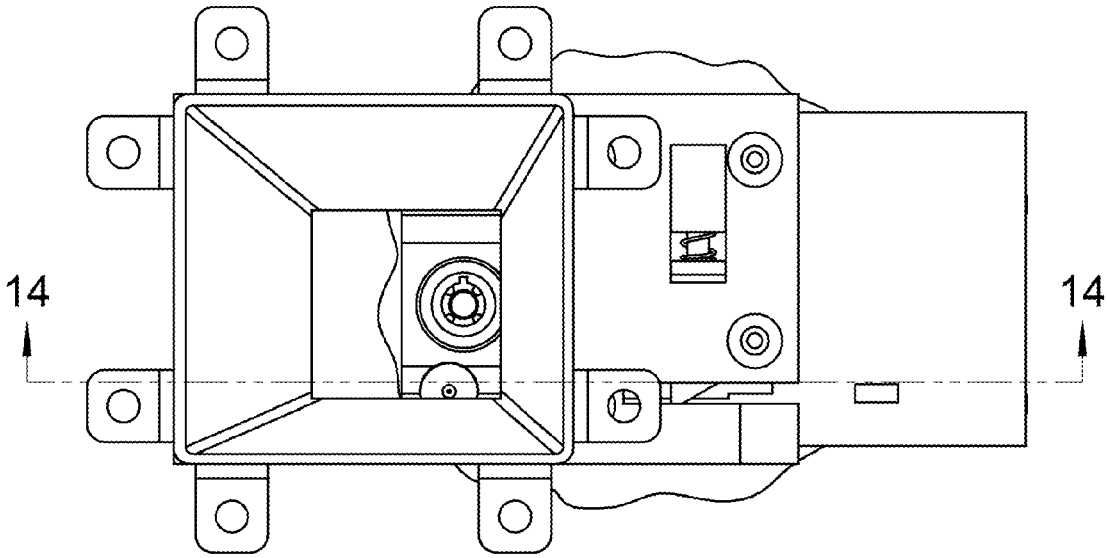
FIG. 25 is a top view of the security locking mechanism with section line 14-14.

Plate 310 has hole 318 which allows coins to pass through into bag 330. The bottom part of plate 310 has legs 315 with step 316 and taper 317. For attaching the plate 310 to bag 330, the legs 315 should pass through ring 320 and protector 340. When ring 320 engages with surface 317, legs 315 bend inside to ring 320 and steps 316 go inside into bag 330. Step 316 passes through ring 320 and snaps to ring 320. The same operation happens during the assembly of protector 340 with plate 310. Step 316 passes through rib 341 and snaps to rib 341 of protector 340. Protector 340 prevents legs 315 from bending and the disassembly of coin bag assembly 300. FIG. 23 and FIG. 24 represent as stated above.

Coin bag assembly 300 slides between ribs 290, 292, 294, and 295 of lower case 280. Plate 310 slides until it engages stops 287 and 288. Counterbore 311 of plate 310 lines up with pin 211 of lock 210. The authorized person presses pin 211 and locked lock 210. Pin 211 is inserted into counterbore 311 to prevent remove coin bag assembly 300 from receptacle 200. At that moment, second unit 500 is fully assembled and ready for installation into a vending machine.

Figure 26:
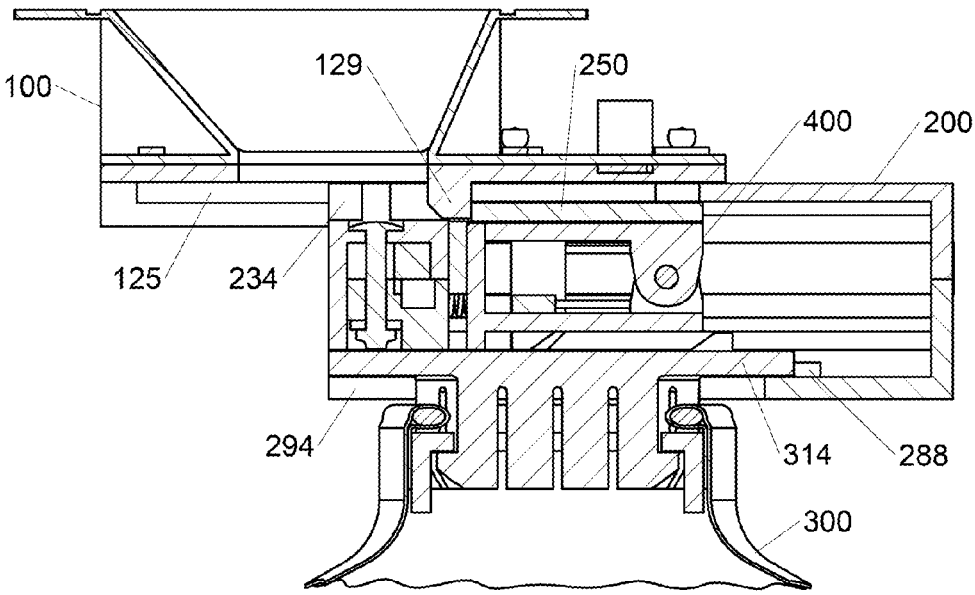
FIG. 26 is a sectional view taken along line 14-14 of the FIG. 25 of the invention shown with the first unit's teeth touching the door of the second unit.

First unit 100 is installed inside the vending machine. A service man takes second unit 500 and lines up ribs 227, 228 of receptacle 200 with grooves 126, 125 of receiver 120. The second unit is connected by sliding ribs 227 and 228 into grooves 125 and 126 of the first unit. During this time, fingers 128 and 129 of receiver 120 slide through grooves 233 and 234 of the receptacle 200 until they reach notches 252 and 253 of door 250. This is shown in FIG. 26.

Figure 28:
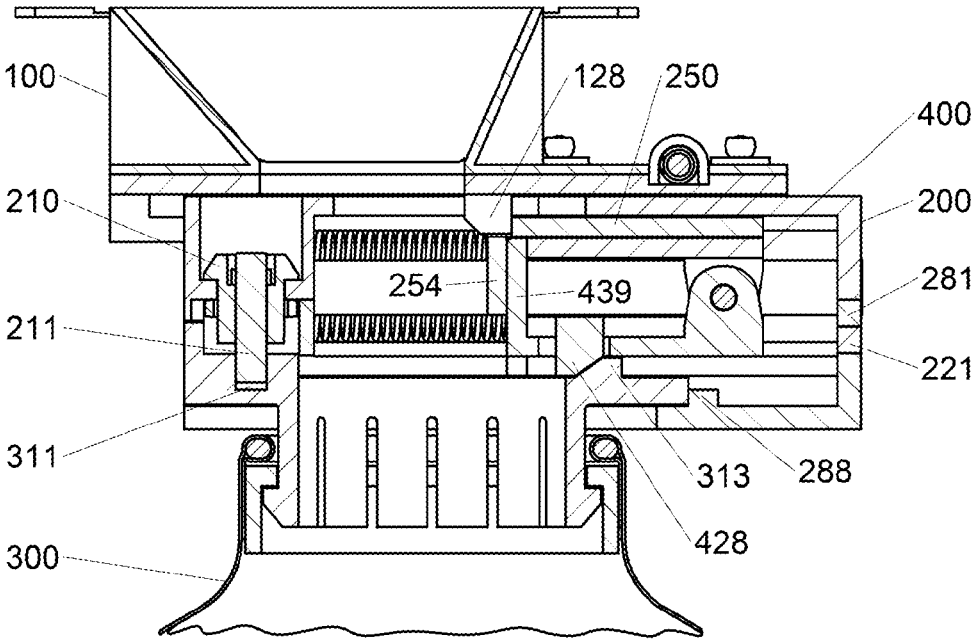
FIG. 28 is a sectional view taken along line 15-15 of the FIG. 27 of the invention showing the first unit's teeth pushing the door with the locking member of the receptacle to reach the stops of the bag holder assembly.

When inserting receptacle 200 into receiver 120, fingers 128 and 129 become engaged with door 250. Fingers 128 and 129 pushes door 250 and stretches extension spring 204 to slightly open window 231 of receptacle 200. This is shown in FIG. 28.

Door 250 has wall 254 which is engaged with wall 439 of slider 430. Thereby locking member 400 travels the same distance with door 250 and stretches extension spring 205.

A service man continuously inserts unit 500 into unit 100. Thereafter fingers 128 and 129 push slightly more door 250 with locking member 400. The arm's teeth 427 and 428 of locking member 400 become engaged with stops 312 and 313 of plate 310.

Figure 27:
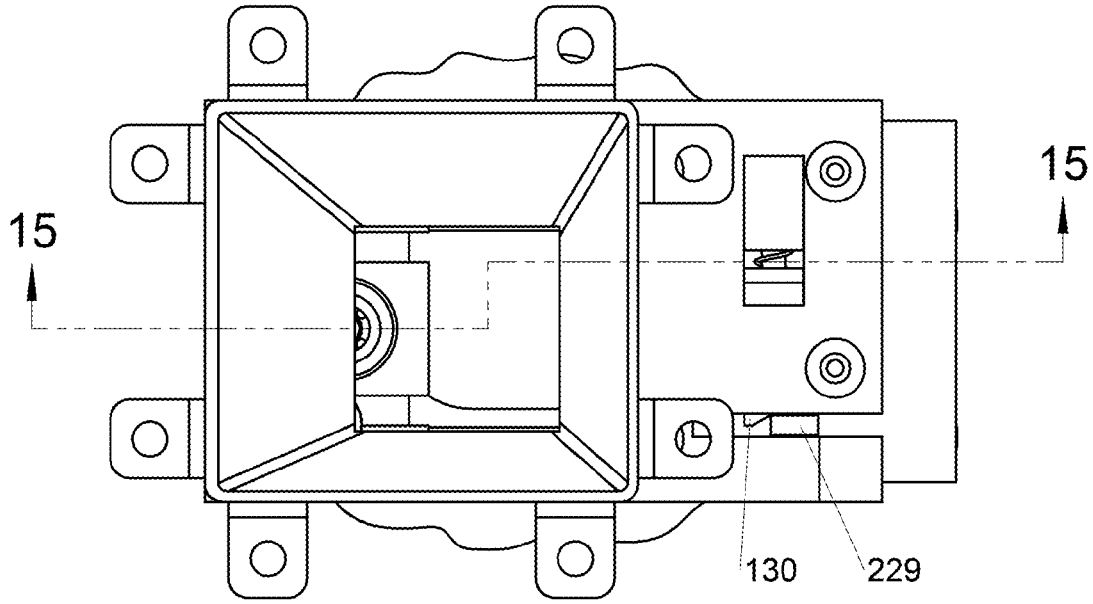
FIG. 27 is a top view of the two units looking downward on the assembly and representing a section line 15-15.

On FIG. 27, finger 229 of receptacle 200 slides into notches 116 and 124 of parts 110 and 120 appropriately. Finger 229 is urging with the angle end of lock 130. Thereafter lock 130 moves and compresses spring 140.

Figure 29:
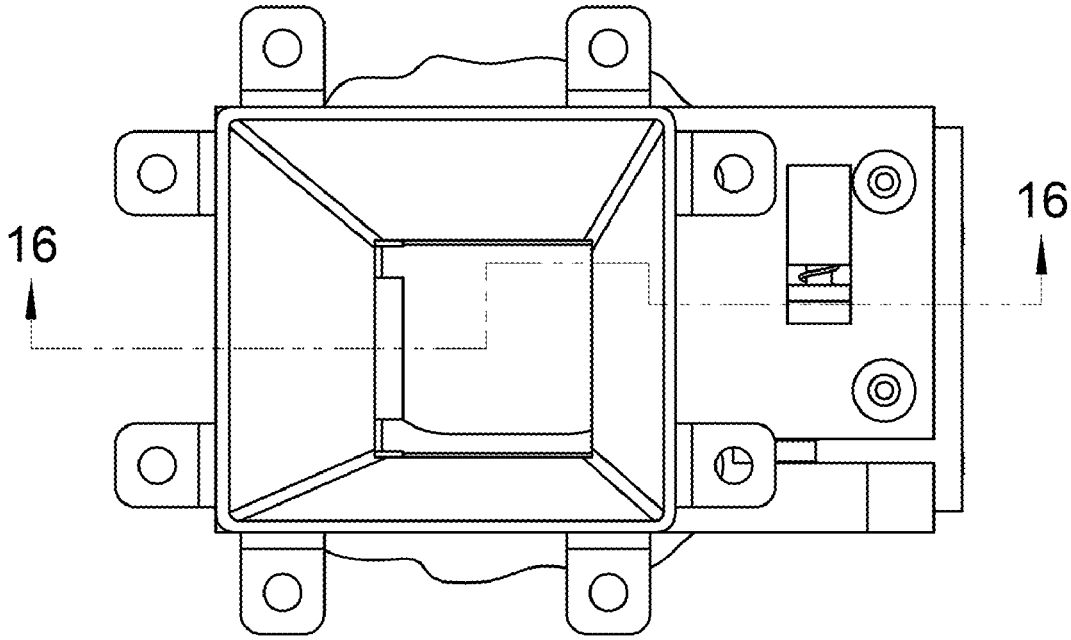
FIG. 29 is a top view on the security mechanism with section line 16-16.
Figure 30:
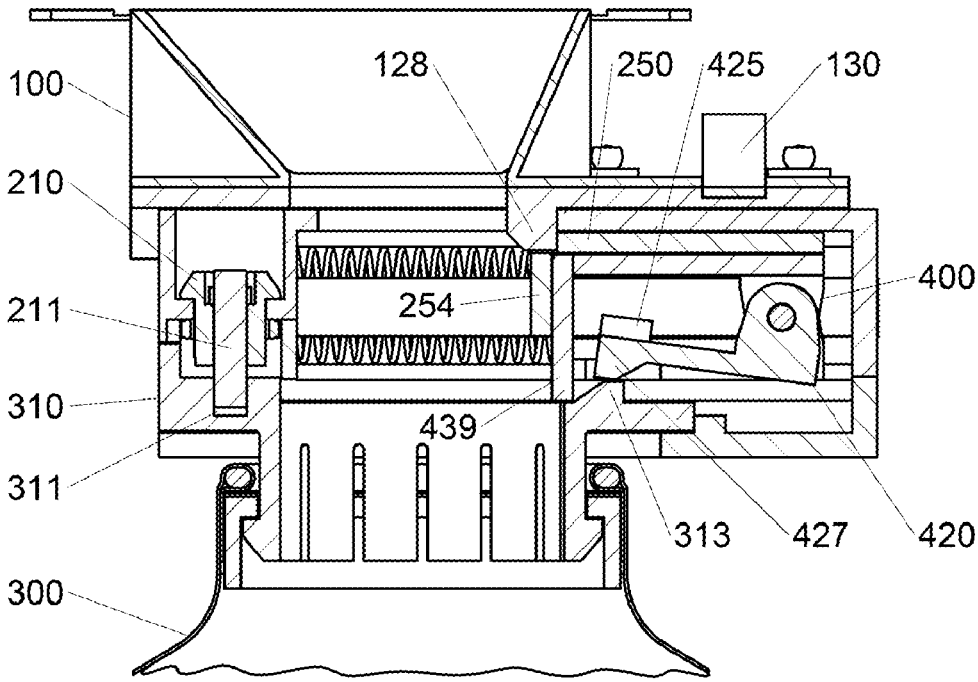
FIG. 30 is a sectional view taken along line 16-16 of FIG. 29 of the invention shown with the first unit's teeth pushing more on the door with the locking member of the receptacle, and the arm sliding on top to the stops of the bag holder assembly.

Unit 500 continuously inserts more into unit 100. Door 250 opens slightly more to move locking member 400. Teeth 427 and 428 slide above stops 312 and 313. Arm 420 pivots and lifts the end with its teeth and compresses spring 402. Finger 229 pushes lock 130 of unit 100 thereby lock 130 moves away from notches 124 and 116. This is shown in FIGS. 29 and 30.

Figure 31:
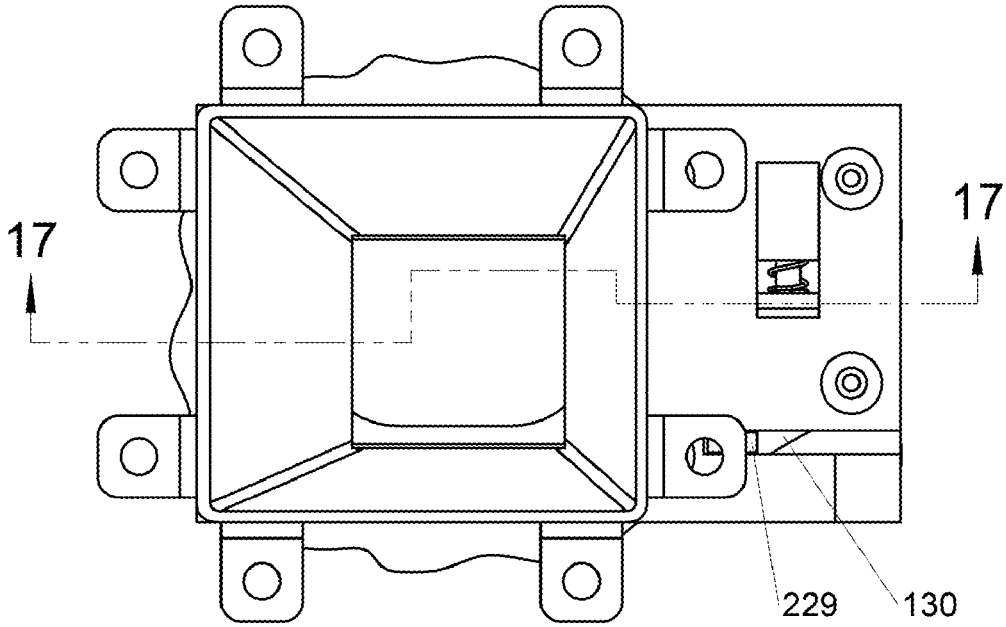
FIG. 31 is a perspective view of the two units looking downward on the assembly and representing a section line 17-17 and the first unit's locking to the receptacle pin.

As the service man fully inserts second unit into first unit, finger 229 of receptacle 200 passes lock 130 of unit 100 and reaches the end of notches 124 and 116 of parts 110 and 120 appropriately. This is shown in FIG. 31. When finger 229 passes lock 130, spring 140 pushes lock 130 back to intersect notches 116 and 124 and lock unit 500 inside unit 100. Fingers 128 and 129 of receiver 120 pass window 231 and reach notches 236 and 237. Door 250 is fully opened and window 231 lines up with windows 119 and 127 of unit 100. Locking member 400 travels with door 250 and teeth 427 and 428 of arm 420 pass stops 312 and 313 of plate 310. Compressed spring 402 moves pivoting arm 420 back until extensions 425 and 426 of arm 420 lay on walls 435 and 436 of slider 430 appropriately. Spring 402 keeps arm 420 in preset condition. At that moment unit 500 is installed into unit 100.

Figure 32:
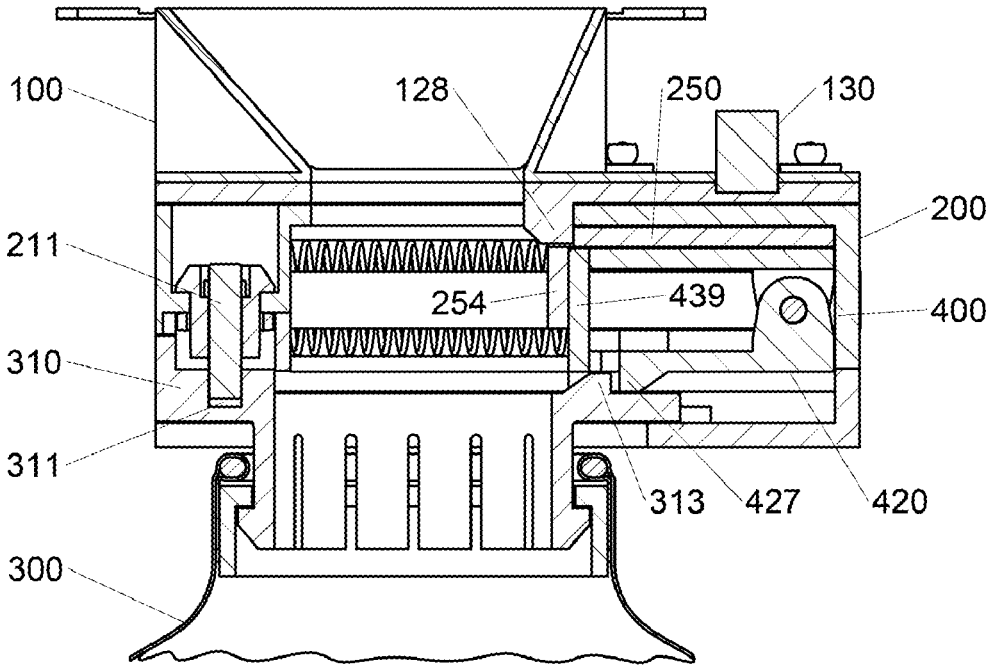
FIG. 32 is a sectional view taken along line 17-17 of the FIG. 31 of the invention shown with the first unit's teeth pushing more the door with the locking member of receptacle and the arm's teeth path the stops of the bag holder assembly.
Figure 33:
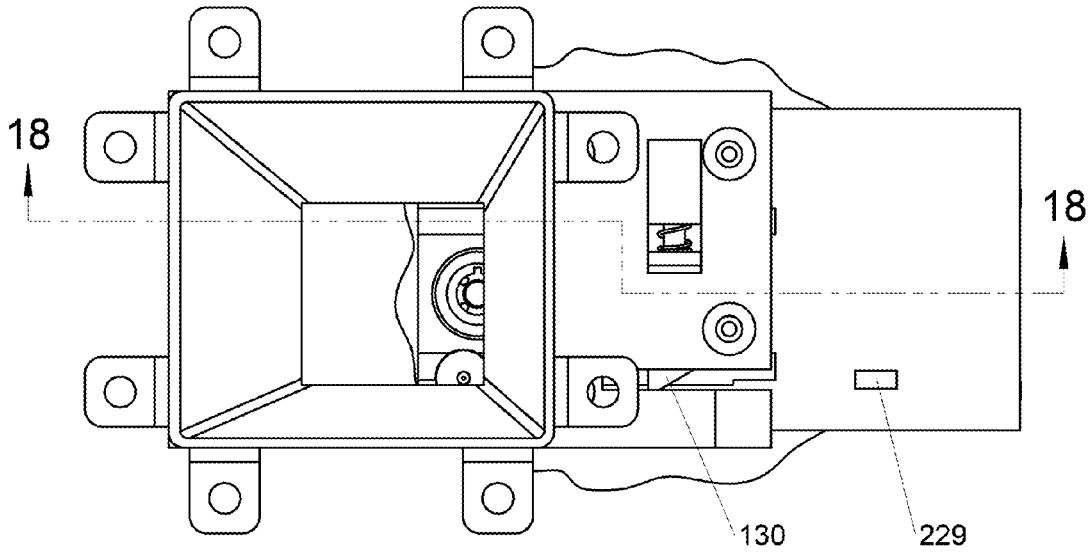
FIG. 33 is a perspective view of the two units looking downward on the assembly and representing a section line 18-18 and the receptacle pin unlocked from the first unit.

Coins can freely pass through security mechanism inside a bag during purchasing any merchandise from a vending machine. FIG. 32 depicts the steps explained above.

After some period, a service man refills the merchandises in the vending machine and replacing the full receptacle. To remove unit 500 from vending machine a service man needs to execute a simple operation. The service man moves handle 132 of lock 130 thereby lock 130 compresses spring 140. Lock 130 slides from notches 116 and 124 of unit 100 and releases finger 229 of receptacle 200. At this moment, door 250 has contact with teeth 128 and 129 of unit 100. Therefore receptacle 200 slides out from receiver 120. Door 250 moves to closed condition. In closed condition, spring 204 moves door 250 to cover slightly window 231 of receptacle 200. At this time, spring 205 moves locking member 400 until teeth 427 and 428 of arm 420 engage with stops 312 and 313 of plate 310. Spring 402 keeps arm 420 in contact with slider 430 and prevents arm 420 from passing stops 312 and 313.

Figure 34:
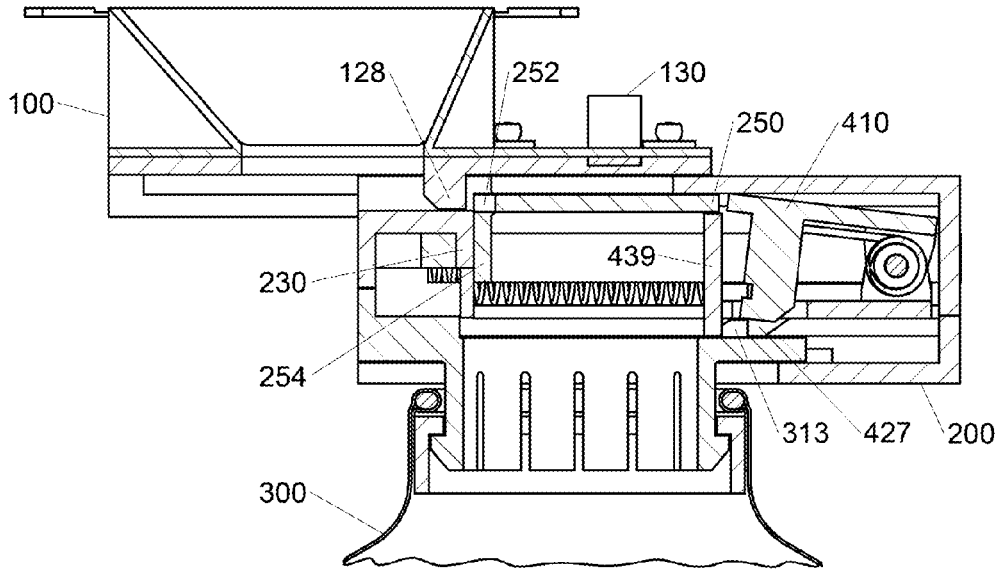
FIG. 34 is a sectional view taken along line 18-18 of the FIG. 33 of the invention shown with the first unit's teeth disengaged with the door. The door slides in closed position and released the stopper of a locking member.
Figure 35:
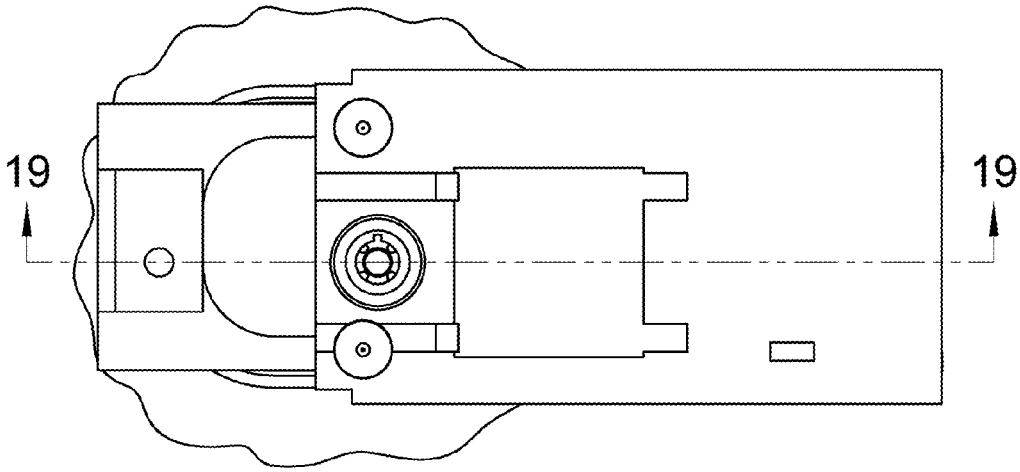
FIG. 35 is a perspective view of the receptacle with the bag holder, looking downward and representing a section line 19-19.

Door 250 moves more to a closed condition and fully covers window 231. Door 250 stops moving when it touches wall 230 of upper case 220 and disengages with stopper 410 of locking member 400. Spring 402 lifts the pivoting end of stopper 410 and blocks door 250 from sliding again in open condition. This is shown in FIG. 34. At that moment, receptacle 200 is locked thereafter only the authorized person can open it. A service man removes unit 500 and delivers it to the main office where an authorized person can remove the coins from the bag with a key.

Figure 36:
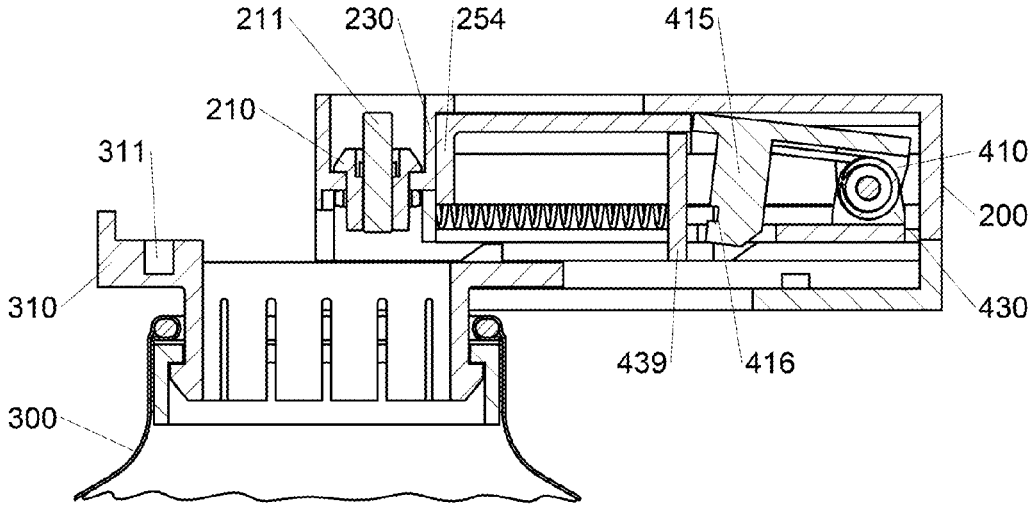
FIG. 36 is a sectional view taken along line 19-19 of the FIG. 35 of the invention, shown with the opened lock of receptacle and removed the bag holder.
Figure 37:
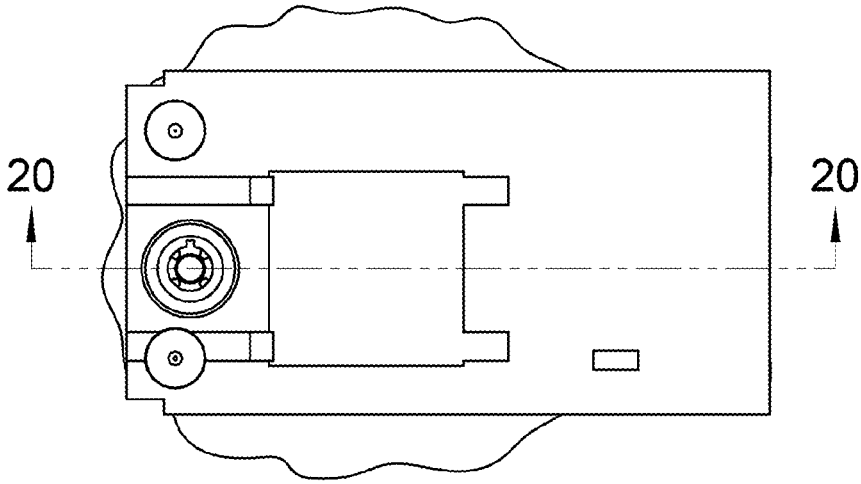
FIG. 37 is a perspective view of the second unit, looking downward on the assembly and representing a section line 20-20.

When second unit is delivered to the main office, the authorized person takes a key for lock 210 and unlocks it. Pin 211 of lock 210 moves from counterbore 311 and releases plate 310. The authorized person removes the plate 310 with attached bag 330 and removes coins from bag 330 through window 318. This is shown in FIG. 36.

Figure 38:
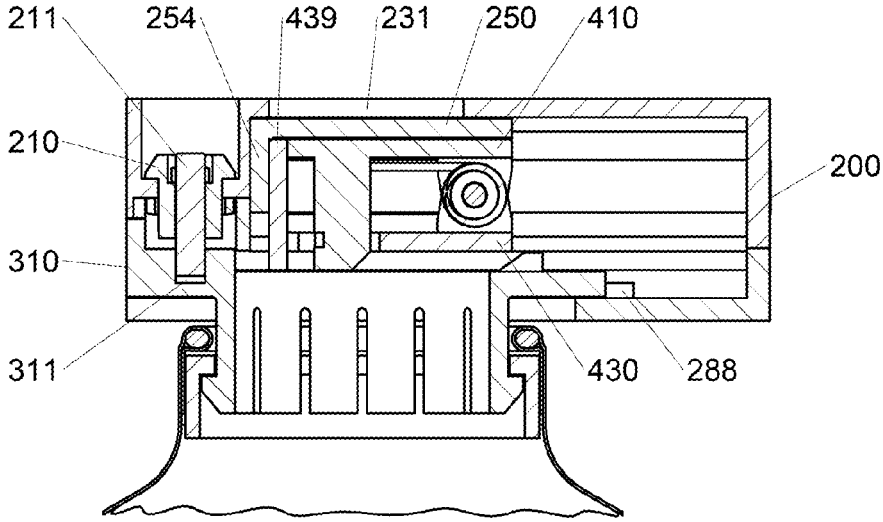
FIG. 38 is a sectional view taken along line 20-20 of the FIG. 37 of the invention and representing the second unit in reset condition.

To reset receptacle 200, authorized person catches notch 416 and pulls handle 415 of stopper 410. Spring 402 is compressed by pivoting stopper 410 on pin 401 and disengages with door 250. At this moment, nothing holds locking member 400. Spring 205 moves locking member 400 to wall 254 of door 250. Now coin receptacle 200 is reset. This is shown in FIG. 38.

Thereafter authorized person installs coin bag assembly 300 into receptacle 200. Plate 310 slides between ribs 290, 292, 294, and 295 until the plate 310 touches teeth 427 and 428 of arm 420. At this moment, plate 310 is not fully inserted. The authorized person pushes arm 420 so it pivots on pin 401 and compresses spring 402. Teeth 427 and 428 disengage from plate 310. Coin bag assembly 300 slightly inserts more into receptacle 200 and passes teeth 427 and 428 of arm 420 prior to stops 312 and 313. The authorized person releases arm 420 so that spring 402 returns to its initial position. Coin bag assembly 300 is fully inserted into receptacle 200. The authorized person pushes pin 211 of lock 210 to fix plate 310. Now second unit 500 is fully assembled and ready to be installed in a vending machine.

I claim:

1. A self-locking security mechanism for a coin operated machine, comprising:

a first unit having an upper mounting connector plate with a funnel extending therefrom, the funnel having a plurality of flexible legs with mounting holes for attachment of the funnel to a coin chute of the coin operated machine, the mounting connector plate being fixed to a lower receiver plate wherein the mounting connector plate has a hole in communication with a hole in the receiver plate to allow passage of coins;

a second unit including an upper receptacle assembly which is slidably attached to a lower coin bag assembly for receiving and storing coins, the upper receptacle assembly being slidably and removably attached to the receiver plate of the first unit such that the first unit is slidably and removably attached to the second unit, and the upper receptacle assembly having an aperture in communication with the holes of the first unit wherein the aperture is opened and closed via a cooperating spring biased sliding door which moves between an open and closed position;

the second unit further comprising a spring biased locking member including a stopper, a pivoting arm receiving a torsion spring, a slider receiving the pivoting arm, and a pin wherein the pin passes through each of the stopper, pivoting arm, torsion spring, and slider for assembly thereof; and wherein, when the second unit is attached to the first unit, the sliding door moves to the open position, and when the second unit is removed from the first unit, the sliding door moves to the closed position and the torsion spring lifts the stopper to prevent the sliding door from moving to the open position.

2. The self-locking security mechanism of claim 1 wherein the lower coin bag assembly comprises a collection plate and a coin collection receptacle, the collection plate comprising a collection aperture and a series of resilient legs, the collection aperture being cooperable with the receptacle assembly such that the collection aperture communicates with the aperture of the upper receptacle assembly and the holes of the first unit, the lower coin bag assembly being received by the resilient legs for receiving coins communicated thereto via the collection aperture, the aperture of the upper receptacle assembly, and the holes of the first unit.

3. The self-locking security mechanism of claim 2 wherein the lower coin bag assembly comprises a resilient ring, the resilient ring being cooperable with the resilient legs for enhancing attachment of the lower coin bag assembly to the collection plate.

4. The self-locking security mechanism of claim 3 wherein the lower coin bag assembly comprises a protector member, the protector member being engageable with both the resilient ring of the lower coin bag assembly and the resilient legs of the collection plate for further enhancing attachment of the lower coin bag assembly to the collection plate.

5. The self-locking security mechanism of claim 4 wherein the resilient legs comprise steps and the protector comprises a rib, the steps extending a first direction and the rib extending a second direction opposite the first direction, the steps and rib coacting to lock the protector to the resilient legs such that the protector prevents the ring from disengaging the resilient legs.

6. A self-locking security mechanism for a coin operated machine, comprising:

a first unit, the first unit comprising an upper mounting connector plate with a funnel extending therefrom, the funnel having a plurality of legs for attachment of the funnel to a coin chute of the coin operated machine, the mounting connector plate being fixed to a lower receiver plate wherein the mounting connector plate has a hole in communication with a hole in the receiver plate to allow passage of coins;

a second unit, the second unit comprising an upper receptacle assembly, the upper receptacle assembly being slidably attached to a lower coin bag assembly for receiving and storing coins, and selectivaly preventing access to a spring-biased locking mechanism, the upper receptacle assembly being slidably attached to the receiver plate such that the first unit is slidably attached to the second unit, the upper receptacle assembly having an aperture in communication with the holes of the first unit, wherein the aperture is opened and closed via a cooperating spring-biased sliding door which moves between an open and closed position by way of door-moving fingers extending from the receiver plate thereby permitting coins to be deposited into the lower coin bag assembly; and wherein when the second unit is attached to the first unit, the sliding door moves to an open position with the locking mechanism, and when the second unit is removed from the first unit, the sliding door moves to the closed position, the locking mechanism for preventing the sliding door from moving to the open position.

7. The self-locking security mechanism of claim 6 wherein the legs of the funnel are constructed from a flexible material, the flexible material of the legs enabling the funnel to be fastened to various structurally configured chutes.

8. The self-locking security mechanism of claim 6 wherein the locking mechanism comprises a slider, a pivot arm, and a pivot stopper, the pivot arm with the pivot stopper receiving a spring for expanding the pivot arm and the pivot stopper in opposing rotational directions relative to a pivot axis; and wherein, when the sliding door moves to the open position with the locking mechanism, the pivot arm pivots via spring action of the spring thereby coacting with the bag assembly to prevent the locking mechanism from sliding back; and when the sliding door moves to the closed position the pivot stopper pivots via spring action of the spring to prevent the sliding door from moving to the open position.

9. The self-locking security mechanism of claim 6 wherein the lower coin bag assembly comprises a plate, a bag-ring assembly, and a protector, the plate comprising a plurality of legs extended therefrom for attachment to the bag-ring assembly, the protector being inside the bag, and when the legs are inserted into the bag-ring assembly and engage the protector, the protector prevents the bag-ring assembly from being removed from the legs.

10. A self-locking security mechanism for a coin operated machine, comprising:

a first unit, the first unit comprising a connector plate, a receiver plate, and a funnel, the connector plate comprising a connector aperture, the receiver plate comprising a receiver aperture, the funnel extending from the connector plate and comprising funnel fastening means, the funnel fastening means for fastening the funnel to a coin chute of the coin operated machine, the connector plate being cooperable with the receiver plate for aligning the connector and receiver apertures for allowing coin passage therethrough; and a second unit, the second unit comprising a receptacle assembly, a door assembly, and a locking assembly, the receptacle assembly being slidably attached to the receiver plate such that the first unit is slidably attached to the second unit, the receptacle assembly comprising a receptacle aperture, the receptacle aperture being in communication with the connector and receiver apertures, the receptacle aperture being opened and closed via the door assembly, the door assembly comprising a spring-biased door, the door being resiliently movable intermediate open and closed positions, the locking assembly comprising a slider-receiving stopper, an arm-receiving slider, a pivot arm, and resilient means, the stopper, the slider, the arm, and the resilient means being interconnected about a pivot axis, the resilient means for resiliently biasing the stopper relative to the arm, the door, when attached to the first unit, being actuably moved to the open position, and when removed from the first unit, being relaxably moved to the closed position, the resilient means relaxably moving the stopper relative to the arm to stop the door from moving to the open position.

11. The self-locking security mechanism of claim 10 wherein the funnel fastening means comprise a plurality of funnel legs, the funnel legs each comprising a leg aperture, the leg apertures for receiving funnel-to-chute fasteners.

12. The self-locking mechanism of claim 11 wherein the plurality of funnel legs radiate outwardly from an upper plane of the funnel for engaging the coin chute via the funnel-to-chute fasteners.

13. The self-locking security mechanism of claim 12 wherein the outwardly radiating legs are constructed from a flexible material, the flexible material enabling the funnel to be fastened to varied structurally configured chutes.

14. The self-locking security mechanism of claim 10 comprising a coin collection assembly, the coin collection assembly for receiving and storing coins, the coin collection assembly comprising a collection plate and a coin collection receptacle, the collection plate comprising a collection aperture and a series of connector legs, the collection aperture being cooperable with the receptacle assembly such that the collection aperture communicates with the receptacle, receiver, and connector apertures, the coin collection receptacle being received by the connector legs for receiving coins communicated thereto via the collection, receptacle, receiver, and connector apertures.

15. The self-locking security mechanism of claim 14 wherein the coin collection receptacle comprises a resilient ring, the resilient ring being cooperable with the connector legs for enhancing attachment of the coin collection receptacle to the collection plate.

16. The self-locking security mechanism of claim 15 wherein the coin collection assembly comprises a protector member, the protector member being engageable with both the resilient ring of the coin collection receptacle and the connector legs of the collection plate for further enhancing attachment of the coin collection receptacle to the collection plate.

17. The self-locking security mechanism of claim 16 wherein the connector legs comprise steps and the protector member comprises a rib, the steps extending a first direction and the rib extending a second direction opposite the first direction, the steps and rib coasting to lock the protector member to the connector legs such that the protector member prevents the ring from disengaging the connector legs.

* * * * *